US009818287B1

(12) United States Patent
Peterson

(10) Patent No.: US 9,818,287 B1
(45) Date of Patent: Nov. 14, 2017

(54) LOAD-INDICATIVE ALARM

(71) Applicant: Altec Industries, Inc., Birmingham, AL (US)

(72) Inventor: Daniel D. Peterson, Kansas City, MO (US)

(73) Assignee: Altec Industries, Inc., Birmingham, AL (US)

( * ) Notice: Subject to any disclaimer, the term of this patent is extended or adjusted under 35 U.S.C. 154(b) by 0 days.

(21) Appl. No.: 15/346,893

(22) Filed: Nov. 9, 2016

(51) Int. Cl.
*G08B 21/00* (2006.01)
*G08B 21/18* (2006.01)

(52) U.S. Cl.
CPC ..... *G08B 21/182* (2013.01)

(58) Field of Classification Search
CPC ..... G08B 21/182
USPC ..... 340/679
See application file for complete search history.

(56) References Cited

U.S. PATENT DOCUMENTS 4,462,474 A * 7/1984 Bordeaux ..... G01G 19/62 177/1
4,787,524 A * 11/1988 Cobb, III ..... B66D 1/58 212/262
5,251,768 A * 10/1993 Yoshimatsu ..... B66C 13/063 212/245
5,714,719 A * 2/1998 Otsuka ..... E02F 9/264 177/141
2003/0034183 A1* 2/2003 Kortesmaki ..... B66F 9/0755 177/142
2004/0084168 A1* 5/2004 Mandel ..... B22D 17/32 164/4.1
2007/0034587 A1* 2/2007 Morath ..... B66C 23/88 212/276
2007/0050115 A1* 3/2007 Discenzo ..... B66C 13/063 701/50
2007/0074910 A1* 4/2007 Kesselman ..... G01G 23/3721 177/25.13
2011/0098891 A1* 4/2011 Inayoshi ..... B60N 2/002 701/45
2011/0278252 A1* 11/2011 De Carvalho Cal ... B66C 23/72 212/279
2012/0037585 A1* 2/2012 Jene ..... B66C 23/905 212/276
2013/0253759 A1* 9/2013 Matsumoto ..... B66C 23/905 701/31.1
2014/0232539 A1* 8/2014 Hiruta ..... G07C 5/08 340/438
2016/0343231 A1* 11/2016 Bump ..... B01F 13/004
2017/0158095 A9* 6/2017 Renaudin ..... B60N 2/2884

* cited by examiner

*Primary Examiner* — Zhen Y Wu
(74) *Attorney, Agent, or Firm* — Erise IP, P.A.

(57) ABSTRACT

A load-indicative alarm system alerts an operator as to a load. The load-indicative alarm system includes a load-measuring device, a controller, and an alerting device. The load-measuring device for provides a load indication. The controller determines a load level by acquiring the first load indication from the load-measuring device. The alerting device is configured to alert the operator. The controller is configured to instruct the alerting device to alert the operator if the current load level is above a minimum threshold. The alerting device provides a load-indicative alert that informs the operator of the load level being above the minimum threshold.

20 Claims, 5 Drawing Sheets

LOAD-INDICATIVE ALARM

BACKGROUND

1. Field

Embodiments of the invention relate to alarm systems associated with various other systems. More specifically, embodiments of the invention relate to alarm systems that are indicative of a load.

2. Related Art

Various alarm systems provide in an indication that a load has been exceeded. For example, an alarm may alert an operator to an excessive load being placed on a boom system of an aerial device. As another example, an alarm may alert an operator that conditions in the motor are exceeding normal safety limits. In many instances, the operator may take preventative measures prevent damage, such as by removing the load from the boom system or reducing the engine speed so as to ensure that the overload does not damage various component. The alarm is therefore intended to inform the operator of when the preventative measures should be manually applied.

Most alarms of the prior art are a single indication that a threshold has been exceeded. In some instances, these alarms are too intrusive such that the operator may desire to and disable the alarm system. In some instances, these alarms are not intrusive enough such that the operator may ignore (consciously or unconsciously) the alert. Further, alarm systems typically do not provide sufficient information as to the severity. What is therefore lacking in the prior art is an alarm system that provides information about the severity and that is intrusive enough to invoke the operator to perform the preventative measures.

SUMMARY

Embodiments of the invention solve the above-mentioned problems by providing a load-indicative alarm system. The load-indicative alarm system provides information about a current load level to the operator. The load-indicative alarm therefore provides information to the user as to the severity of the situation. This allows the operator to select when and how to take preventative measures. The alarm may therefore increase the likelihood that the operator takes the appropriate preventative measures to prevent damage to the motor or other components of the system.

A first embodiment of the invention is directed to a load-indicative alarm system configured to alert an operator as to the load on a system, the load indicative alarm system comprising a load-measuring device, a controller, and an alerting device. The load-measuring device provides a load indication. The controller is configured to determine a load level, wherein the controller is configured to determine the load level by acquiring the first load indication from the load-measuring device. The alerting device is configured to alert the operator. The controller is configured to instruct the alerting device to alert the operator if the current load level is above a minimum threshold, wherein the alerting device provides a load-indicative alert that informs the operator of the load level being above a minimum threshold.

A second embodiment of the invention is directed to a computerized method of providing an alert to an operator that is indicative of the load on a system, the method comprising the following steps: acquiring a first load indication from a load-measuring device at a time T1; determining a first load level based at least in part on the first load indication; instructing an alerting device to provide a first load-indicative alert, wherein the first alert is indicative of the first load level; acquiring a second load indication from the load-measuring device at a time T2; determining a second load level based at least in part on the second load indication; instructing the alerting device to provide a second load-indicative alert that is indicative of the second load level, wherein the second load-indicative alert is distinguishable from the first load-indicative alert, wherein the first load level is different than the second load level, wherein the first load level and the second load level are each above a minimum threshold.

A third embodiment of the invention is directed to a non-transitory computer readable medium having a computer program stored thereon for presenting a load-indicative alarm to an operator of machinery, wherein the computer program is configured to instruct a processing element to perform the following steps: acquiring a first load indication from a load-measuring device at a time T1; determining a first load level based at least in part on the first load indication; instructing an alerting device to provide a first load-indicative alert, wherein the first alert is indicative of the first load level; acquiring a second load indication from the load-measuring device at a time T2; determining a second load level based at least in part on the second load indication; instructing the alerting device to provide a second load-indicative alert that is indicative of the second load level, wherein the second load-indicative alert is distinguishable from the first load-indicative alert, wherein the first load level is different than the second load level, wherein the first load level and the second load level are each above a minimum threshold, wherein the minimum threshold is associated with a safe operating condition.

Another embodiment of the invention may be directed to an aerial device, including a base, a boom assembly, and a load-indicative alarm system. Still another embodiment of the invention may be directed to a wood chipper system, including an engine, a flywheel, and a load-indicative alarm system. Yet another embodiment of the invention may be directed to an engine control system including an engine and a load-indicative alarm system. Yet a further embodiment of the invention may be directed to a vehicle system, including an engine, a chassis, and a load-indicative alarm system. Other embodiments of the invention will also be discussed throughout the current disclosure.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
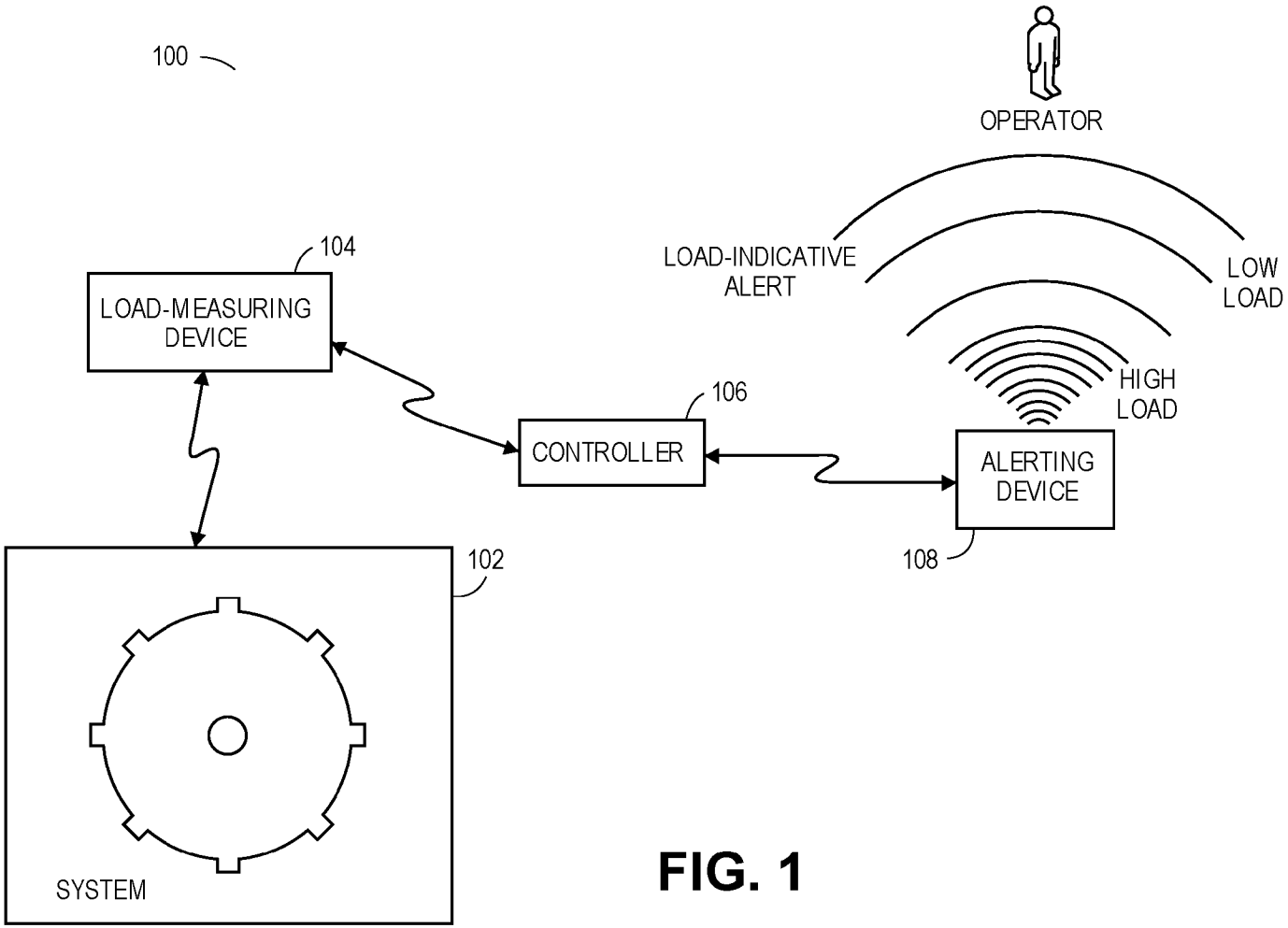
FIG. 1 is a block diagram illustrating the various component of a load-indicative alarm system.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Figure 2:
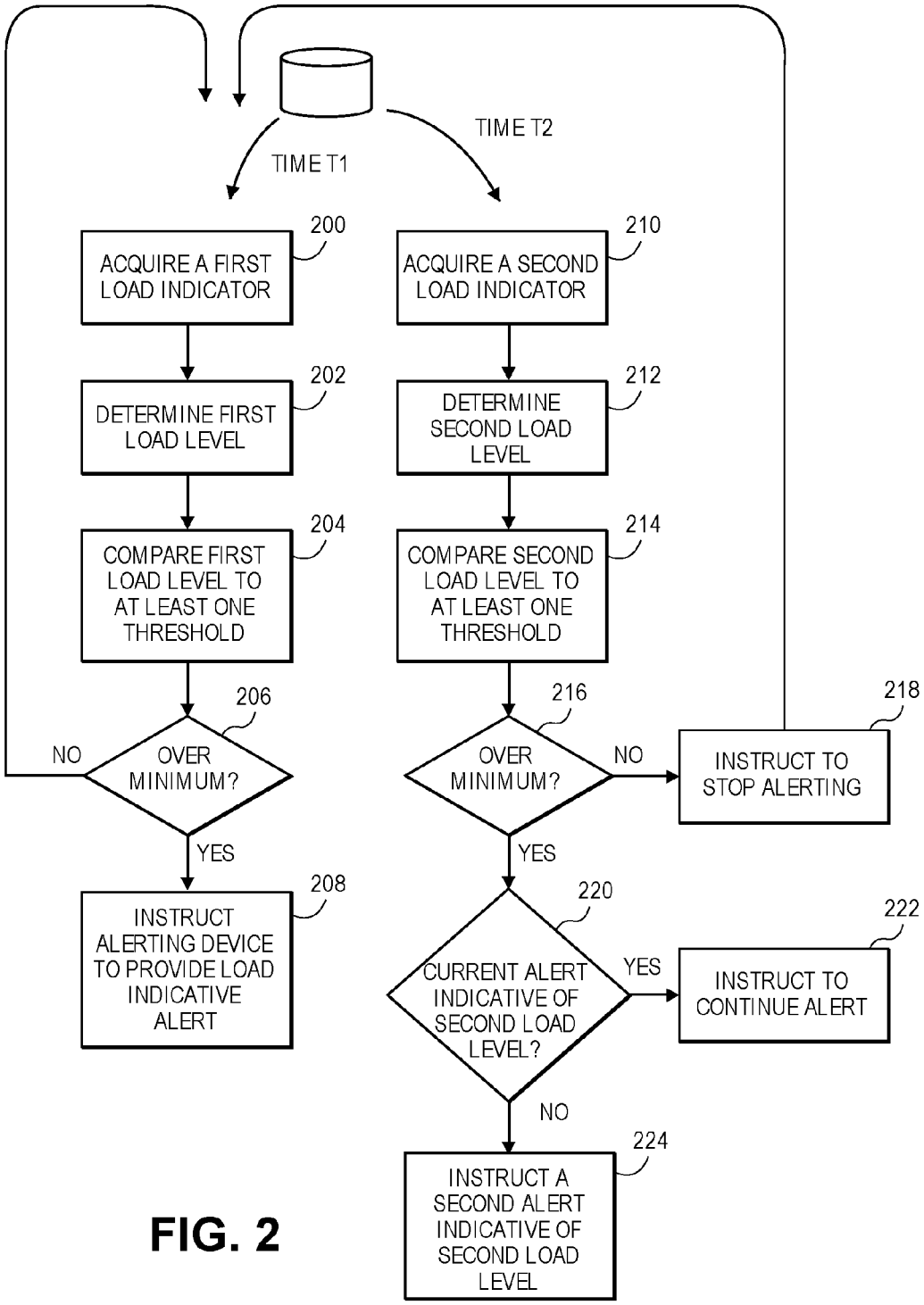
FIG. 2 is a flow diagram illustrating exemplary steps of a method of presenting a load-indicative alert.
Figure 3:
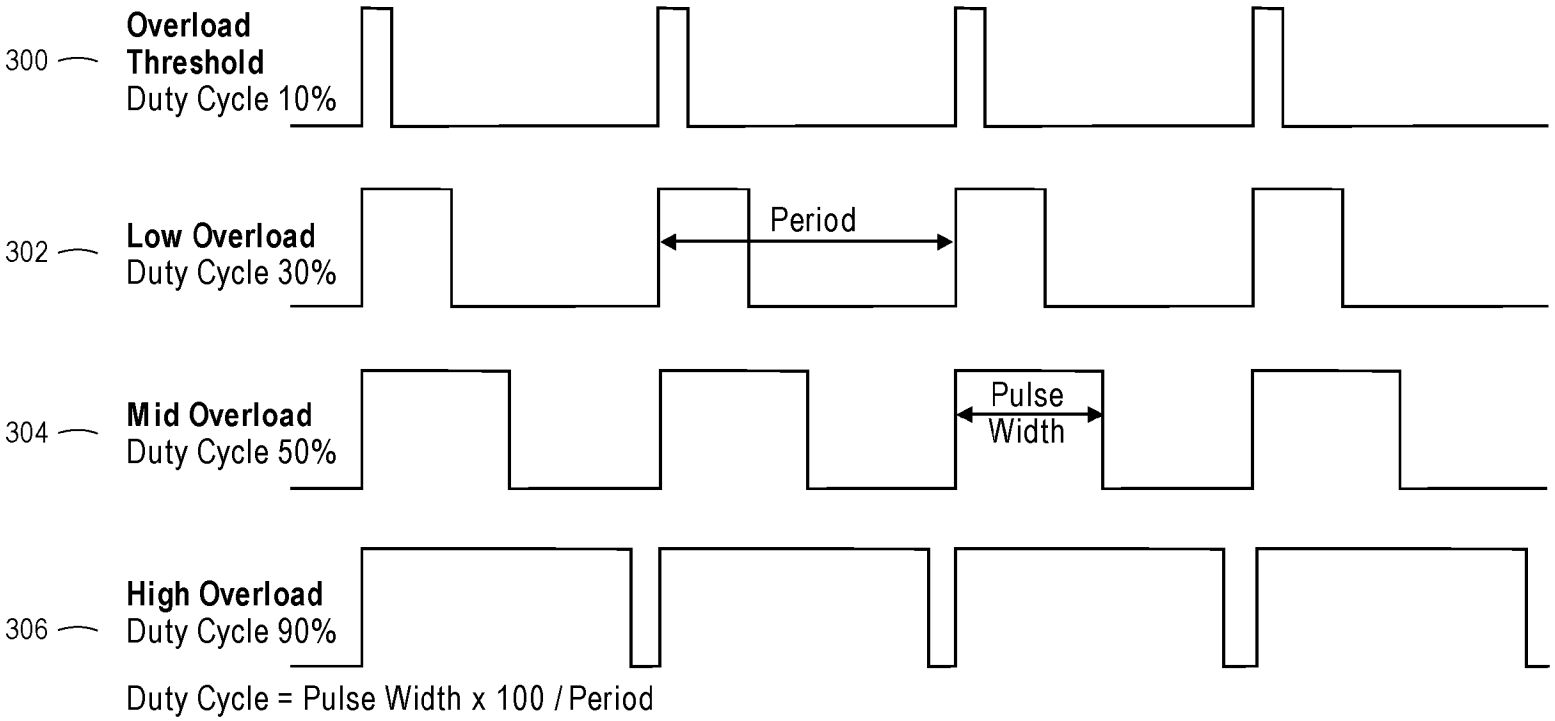
FIG. 3 is a diagram illustrating properties of an exemplary load-indicative alert.

A load-indicative alarm system 100 is configured to be utilized in conjunction with a system 102 is illustrated in FIG. 1. In embodiments of the invention, the load-indicative alarm system 100 comprises a load-measuring device 104, a controller 106, and an alerting device. The load-measuring device 104 determines an amount of load that is placed on the system 102 (such as a weight suspended from or otherwise associated with a component of the system 102, an engine of the system 102, a cutter, a drum, or some other component of the system 102). The load-measuring device 104 sends information indicative of a measurement to the controller 106. The controller 106 determines the current load on the system. Based upon the determined load, and at least one threshold, the controller 106 determines whether to issue an alert and, if so, the characteristics of such alert. The steps of an exemplary method are shown in FIG. 2. An exemplary load-indicative alert is shown in FIG. 3.

Returning to FIG. 1, an exemplary load-indicative alarm system 100 is illustrated. The load-indicative alarm system 100 configured to alert an operator as to the load on a system 102. In embodiments of the invention, the load-indicative alarm system 100 comprises at least one load-measuring device 104, a controller 106, and an alerting device 108. The load-measuring device 104 provides a load indication. The controller 106 is configured to determine a load level upon acquiring the first load indication from the load-measuring device 104. The alerting device 108 is configured to alert the operator of the load level. The controller 106 is configured to instruct the alerting device 108 to alert the operator if the current load level is above a certain threshold. The alerting device 108 provides a load-indicative alert that informs the operator of the load level. This enables the operator to then take preventative actions to prevent damage to the system based upon the load.

The system 102 performs a certain task or function. For example, the system 102 may be associated with an aerial device or wood chipper, as discussed below. During the performance of the task or function, the system 102 experiences a load thereon. Excessive loads (in magnitude and/or duration) cause damage to the system 102 or other components of the system. Excessive load may also reduce efficiency and the quality of the performance of the task or function. Therefore, detection and reduction of the excessive load may reduce or prevent damage, and promote efficiency for the system 102.

The load-measuring device 104 is associated with the system 102 to determine a load indication. The type of load may vary depending on the type of system 102 on which the load-measuring device 104 is used. Two exemplary types of loads that may be emplaced on an exemplary system 102 are discussed below in regards to FIG. 4 and FIG. 5.

The controller 106 provides processing functionality for the load-indicative alarm system 100 and may include any number of processors, micro-controllers, or other processing systems, and resident or external memory for storing data and other information accessed or generated by the load-indicative alarm system 100. The controller 106 may execute one or more software programs that implement the techniques and modules described herein. The controller 106 is not limited by the materials from which it is formed or the processing mechanisms employed therein and, as such, may be implemented via semiconductor(s) and/or transistors (e.g., electronic integrated circuits (ICs)), and so forth. It should also be appreciated that the discussed functions and methods performed by the controller 106 may be performed by other processors.

The alerting device 108 provides the load-indicative alert to the operator. As shown, the load-indicative alert may represent a relatively low load (for example, that is still over the minimum threshold but not an imminent threat) and a relatively high load (for example, that is an imminent threat to harm to the system). The alert may include audible alarms, audible voices, visual alarms, visible words, or the like (or some combination thereof). Examples of an alerting device 108 may include a speaker system, a display device, a headphone worn by the operator, light sources, and other similar devices. The load-indicative alert is discussed in more detail below with regards to FIG. 3.

Various methods of the invention will now be discussed. A method of alerting an operator of a load on a system is illustrated in FIG. 2. Broadly this method checks the load upon the system, determines whether the load is above a certain threshold, and if so provides an alert to the operator of such. The method then continues to monitor the load on the system, based upon a change in the load the alert may either stop, continue, or change a certain attribute. It should be appreciated that in the discussed steps, the controller 106 is discussed as performing the various steps. It should be appreciated that this is only an exemplary embodiment of the invention. In other embodiments, other electronic components or a combination thereof may perform any or all of the discussed steps.

In Step 200, the controller 106 acquires a first load indication from a load-measuring device 104. In some embodiments, the step of acquiring is active, in that the controller 106 samples, retrieves, or otherwise actively acquires the first load indication from the load-measuring device 104. In other embodiments, the step of acquiring is passive, in that the controller 106 receives a message, a signal, or some other electronic information that is indicative of the first load indication. It should also be appreciated that the controller 106 may be acquiring numerous different load indications simultaneously or in rapid succession. For example, there may be a plurality of load-measuring devices 104 throughout the system that provide independent load indications for their respective region or component.

In Step 202, the controller 106 determines a first load level for the system. The load level is based at least in part on the first load indication. The load level may additionally be based upon other load indications and other operating parameters of the system. The load level may be expressed as a percentage, a ratio, a measured value, or other expression. In embodiments of the invention, the load level is indicative of the amount of work being performed. The load level is then compared against known qualities about the system, such as maximum loads that can be withstood without damaging the system.

In Step 204, the controller 106 compares the first load level to at least one threshold. The controller 106 determines whether the first load level is above the threshold. In embodiments of the invention, the controller 106 may compare the first load level against several thresholds, such as a minimum threshold, an intermediate threshold, and a high threshold (as discussed below).

As used herein, "threshold" means a value, ratio, equation, or other expression. The threshold is indicative of certain conditions within the system. For example, the motor may have a certain safe operating rate. Exceeding this operating rate may cause damage to the system 102. Therefore, there may be various thresholds associated with the system 102. Operating at a very high rate may cause damage quickly or almost immediately, operating at a high rate may cause damage after a moderate amount of time, and operating at an intermediate rate may cause damage after a very long amount of time. Other factors may also affect the threshold, such as operating temperatures, the type of work being performed, other strains and tasks being performed by the system, and the like. Therefore, in some embodiments of the invention, the threshold may be determined based upon indications of various conditions within the system. In other embodiments, the threshold may be a static, predetermined value, based upon various static and known characteristics of the system.

In Step 206, the controller 106 determines whether the first load level is above a minimum threshold. If the first load level is not above the minimum threshold, the steps may continue acquiring load indications, at Step 200, and continue to check the acquired load indication against the threshold.

In Step 208, the controller 106 instructs the alerting device 108 to provide a load-indicative alert. In embodiments of the invention, the controller 106 may directly power or otherwise cause the alerting device 108 to provide the load-indicative alert. In other embodiments of the invention, the controller 106 may send a message instructing the alert and/or the load associated therewith. The load-indicative alert is discussed below with relation to FIG. 3.

In Step 210, at a time T2, the controller 106 acquires a second load indication. The second load indication provides information indicative of the load at the time T2. In embodiments of the invention, the Step 210 is substantially similar to the Step 200 discussed above. In some embodiments, the step of acquiring is active, in that the controller 106 samples, retrieves, or otherwise actively acquires the first load indication from the load-measuring device 104. In other embodiments, the step of acquiring is passive, in that the controller 106 receives a message, a signal, or some other electronic information that is indicative of the first load indication. It should also be appreciated that the controller 106 may be acquiring numerous different load indications simultaneously or in rapid succession. For example, there may be a plurality of load-measuring devices 104 throughout the system that provide independent load indications for their respective region or component.

It should be appreciated that the time T1 (in which Step 200 is initiated) and the time T2 (in which Step 210 is initiated) can be any relative times. In various embodiments of the invention, the controller 106 will be sampling, receiving, or otherwise acquiring load indications occasionally, periodically, continuously, or substantially continuously. Additionally or alternatively, the controller 106 may be sampling, receiving, or otherwise acquiring the load indication only upon the presence of certain conditions. For example, the system 102 at idle may not report load indications.

In embodiments of the invention, the time T2 is later than the time T1. As such, the controller 106 may continue to cycle through the Steps 200-206 through the load level is found to exceed the minimum threshold in Step 206. The controller 106 may then continue to sample the load-measuring device 104 in substantially the same rate and manner. It should therefore be appreciated that the times T1 and the time T2 are nomenclatures to describe the steps that may be performed with a load indication. Other time nomenclatures may also be used, such as a time T3, T4, and so forth.

In Step 212, the controller 106 determines a second load level for the system. The second load level is based at least in part on the second load indication. The load level may additionally be based upon other load indications and other operating parameters of the system, as well as previous load indications such as the first load indication described in Step 202 above. In embodiments of the invention the second load level for the system is determined in the same method as the first load indication was determined in Step 202.

In Step 214, the controller 106 compares the second load level to at least one threshold. In embodiments of the invention, the at least one compared threshold may be predetermined, set, fixed, or variable. The controller 106 determines whether the second load level is above the threshold. In embodiments of the invention, the controller 106 may compare the second load level against a plurality of thresholds, such as a minimum threshold, an intermediate threshold, and a high threshold (as discussed below).

In Step 216, the controller 106 determines whether the second load level is above the minimum threshold. If the second load level is below the minimum threshold, this is indicative that the load has decreased (as the first load level was above the minimum threshold). In Step 218, the controller 106 will then instruct the alerting device 108 to stop the load-indicative alert. This is because the load level has fallen back into the normal operating range (which may be due to the operator performing preventative measures, the load reducing due to the material feed rate decreasing, or because the minimum threshold has changed due to various factors as discussed below). The controller 106 may then return to Step 200 and monitor the load level to determine when and if another load-indicative alert should be initiated.

In Step 220, the controller 106 determines whether the current load-indicative alarm is indicative of the second load level. If the current load-indicative alarm is indicative of the second load level, in Step 222, the controller 106 may instruct the alerting device 108 to continue the alert (or may provide no instruction such that the alerting device 108 continues the current load-indicative alarm as previous instructed in Step 208). In these embodiments, the second load level may be within the same threshold region as the first load level, as discussed below, such that a change in the load-indicative alarm is not necessary.

In Step 224, if the controller 106 determined that the load-indicative alarm is not indicative of the second load level, the controller 106 instructs the alerting device 108 to provide a second load-indicative alert that is indicative of the second load level. The second load-indicative alert informs the operator of the second load level. The second load-indicative alert is therefore configured to inform the operator that the second load level is either higher or lower than the first load level. This may be done by altering various aspects of the load-indicative alert. One exemplary aspect of the load-indicative alert that may be altered is the duty cycle, as discussed below in relation to FIG. 3. Other aspects of the load-indicative alert may additionally or alternatively include the pitch, the frequency, the length of the duty cycle, the type of alert, the volume, the duration, the words or numbers spoken or displayed, colors used, flashing rapidity, or other aspect of a visual and/or audio alarm.

The controller 106 may also determine if the second load level is over a maximum threshold. The maximum threshold is indicative of imminent or incipient damage to the system due to the load thereon. The controller 106 may then instruct the system to take various preventative actions, as described below.

Turning to FIG. 3, an exemplary load-indicative alarm is illustrated. In the illustrated example, the load-indicative alarm is presented over a duty cycle. The duty cycle includes a tonal portion (labeled as a "Pulse Width" in FIG. 3) and a silent portion. In embodiments of the invention, the duty cycle has a period (as labeled in FIG. 3) of fixed length. For example, the period duty cycle may be one second, two seconds, or other length of time. In other embodiments, the length of the duty cycle may vary in order to demonstrate the severity level of the load-indicative alarm (for example, the controller 106 may make the length of the duty cycle shorter or longer so as to emphasize the load-indicative alarm). Each cycle includes a proportion that is the tonal portion and a corresponding proportion that is the silent portion. FIG. 3 is divided into four exemplary diagrams: Overload Threshold 300, Low Overload 302, Mid Overload 304, and High Overload 306. Each exemplary diagram illustrated a level of the load-indicative alarm. For example, the top illustrated example, includes a 10% tonal portion and a 90% silent portion (referred to as "Duty Cycle 10%" in FIG. 3).

An exemplary load-indicative alarm is illustrated in FIG. 3. The load-indicative alarm includes five associated thresholds (not illustrated) a minimum threshold, a low-intermediate threshold, a mid-intermediate threshold, a high-intermediate threshold, and a maximum threshold. It should be appreciated that if the system 102 (or some component of the system 102) is experiencing a normal, standard load, that no load-indicative alert will sound. The below-discussed components of the load-indicative alert are utilized upon the system 102 (or other component of the system) approaching an unsafe or otherwise excessive load.

In embodiments of the invention, the overload threshold 300 is triggered upon the load level meeting or exceeding the minimum threshold (while being below the low intermediate threshold). The overload threshold 300 is characterized by 10% duty cycle. In the 10% duty cycle, the alert provides a tonal portion for 10% of the duty cycle and a silent portion for the remaining 90% of the duty cycle. The overload threshold is therefore indicative of the load level beginning to approach the unsafe conditions. The 10% duty cycle is therefore designed to provide a gentle alert to the operator to inform the operator of the current load on the system.

In embodiments of the invention, the low overload 302 is triggered upon the load level meeting or exceeding the low-intermediate threshold (while being below the mid-intermediate threshold). The low overload is characterized by a 30% duty cycle. In the 30% duty cycle, the alert provides a tonal portion for 30% of the duty cycle and a silent portion for the remaining 70% of the duty cycle. The tonal portion of the load-indicative alarm is increased noticeably. This provides information to the operator that the load on the system has increased (and/or that the time under the load has exceeded a certain time threshold).

In embodiments of the invention, the mid overload 304 is triggered upon the load level meeting or exceeding the mid-intermediate threshold (while being below the high-intermediate threshold). The mid overload is characterized by a 50% duty cycle. In the 50% duty cycle, the alert provides a tonal portion for 50% of the duty cycle and a silent portion for the remaining 50% of the duty cycle. This 50% on/off cycle may be easily discerned by the operator.

In embodiments of the invention, the high overload 304 is triggered upon the load level meeting or exceeding the high-intermediate threshold (while being below the maximum threshold). The high overload is characterized by a 90% duty cycle. In the 90% duty cycle, the alert provides a tonal portion for 90% of the duty cycle and a silent portion for the remaining 10% of the duty cycle. The high overload provides a nearly continuous tonal portion, with punctuated silent portions. The high overload therefore conveys a message that damage to the system is incipient.

It should be appreciated that the above-discussed percentages are merely exemplary so as to illustrate concepts to the reader. Other embodiments of the invention may utilize any percentage or threshold.

In embodiments of the invention, when the load level exceeds the maximum threshold, the system may take preventative measures. The preventative measures taken by the system can include lowering a component of the system 102, reducing the system 102 speed, stopping the system 102, engaging a clutch to remove the flywheel or other component from the system 102 and/or the cutting mechanism, reversing the feed roller or other component, or other action that may reduce or prevent damage to the system (as discussed below). The load-indicative alarm may also sound during a reversing of the feed roller, which may be typically known as a back-up alarm. The load-indicative alarm may therefore provide an indication of the speed in which the feed roller is being reversed.

The system may additionally or alternatively provide a continuous alarm (e.g., a 100% duty cycle) while the load level is above the maximum threshold. The continuous alarm is designed to be very intrusive so as to demonstrate the importance of the alarm to the operator. As with other embodiments of the invention, the continuous alarm may alter other aspects, such as volume and/or pitch, in order to assist the operator in hearing the continuous alarm and taking notice thereof.

In other embodiments of the invention, there may be another number of intermediate thresholds (other than the low-intermediate threshold, the mid-intermediate threshold, and the high-intermediate threshold discussed above). For example, the number of intermediate thresholds could be one, two, four, five, or more. The number of intermediate thresholds may not be fixed, but may be determined based upon the available readings.

In still other embodiments of the invention, there are no intermediate thresholds between the minimum threshold and the maximum threshold. In these embodiments the tonal portion of the load-indicative alarm may be proportional (either directly or indirectly) to the load level relative to an overload range. The overload range is the scale between the minimum threshold and the maximum threshold. For example, normal operating parameters for the system may be up to 3,000 rotations per minute ("RPM") with unsafe damaging conditions at 5,000 RPM. The overload range in this example would be from 3,000 RPM to 5,000 RPM, representing the minimum threshold and maximum threshold, respectively. If the current load level is 3,500 RPM, this is 25% of the overload rang. As such, in embodiments of the invention, the load-indicative alarm may utilize a 25% duty cycle to inform the operator of the current load level. While the operator will likely be unable to precisely discern the load level from the audible load-indicative alert, the operator will be provided with general information as to the current load level.

In other embodiments of the invention, the duty cycle of the is not necessarily directly proportional to the overload range. Instead, the duty cycle is indicative of a severity level. The severity level may be based upon factors in addition to the load level, such as the amount of time the load has been applied, the type of load that is applied, a rate of increase or decrease in the load, temperature sensor readings, battery levels, fuel levels, and other factors. The severity level may also be based upon the angles and extensions of the various components of the system 102 (such as a boom assembly as discussed below). In these embodiments, the severity level represents an approximation of the danger to the system based upon the various factors considered.

In some embodiments, the alarm presents the utility worker with a visual indication, an audible indication, or other type of indication to let the utility worker know that a potentially unsafe condition exists. In some embodiments, the alarm is configured to communicate with a remote, external computer system. The external computer system may be associated with a headquarters location, a maintenance location, supervisor location, or other location. This allows corrective action to be taken and monitored.

Figure 4:
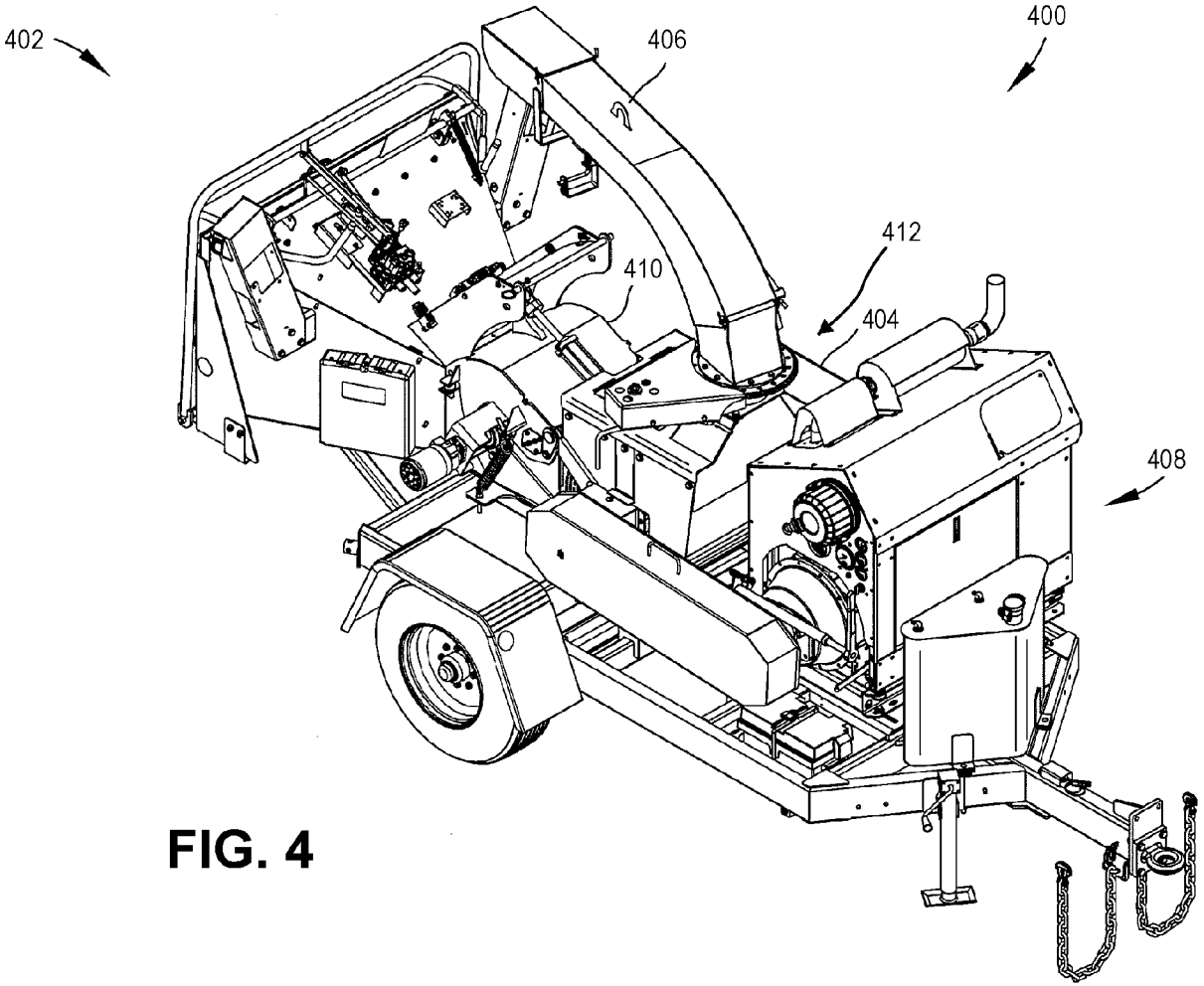
FIG. 4 is a perspective view of an exemplary wood chipper that may incorporate the load-indicative alarm system to measure loads upon an engine.

Embodiments of the invention are directed to use with wood chippers, as illustrated in FIG. 4 as an exemplary field of use. As used herein, a wood chipper 400 may broadly include any type of machine or device that reduces wood (e.g., trees, limbs, brush, etc.) into smaller woodchips. The wood chipper 400 generally includes an inlet hopper 402 for receiving wood into the wood chipper 400; a cutting mechanism 404, such as a rotary cutting disc, a drum blade, or a screw blade, which operates to reduce the received wood into smaller woodchips; a discharge chute 406 for ejecting the smaller woodchips from the wood chipper 400; and an engine 408 for providing power to the cutting mechanism 404 (which may be the same as or different than the system 102 illustrated in FIG. 1). In certain other embodiments, the wood chipper 400 400 may include additional associated components such as feed rollers 410 for assisting the wood as the wood is introduced into the wood chipper 400. Further, the wood chipper 400 may include a mechanical flywheel 412 or other similar component for storing energy and providing the stored energy to the cutting mechanism 404 of the wood chipper 400 or other associated components as needed.

In these embodiments, the load that is measured is the load on the system 102, the motor, the fly wheel, the lift cylinders, or some combination thereof. The alert that is provided to the operator is therefore indicative of potential damage of other adverse effects that may result from the continued use of the wood chipper 400 at the current load. The preventative actions that the operator can use to reduce damage to the wood chipper 400 can include reducing the rate of feed of material into the wood chipper 400, reducing the amount of feed into the wood chipper 400, pausing between the feeding of material, changing the type of material being fed, changing the manner in which the material is being fed, or other load-reducing activity.

In some embodiments, the load-measuring device 104 may detect a speed of the system 102, a speed of a shaft or flywheel 412, the speed of the cutting mechanism 404, a force of material being added, or other parameter that may be indicative (either directly or indirectly) of the amount of load on the system 102. In embodiments of the invention, the load-measuring device 104 may be adjacent to, secured to, proximate to, or otherwise associated with the system 102 (or other respective component).

Figure 5:
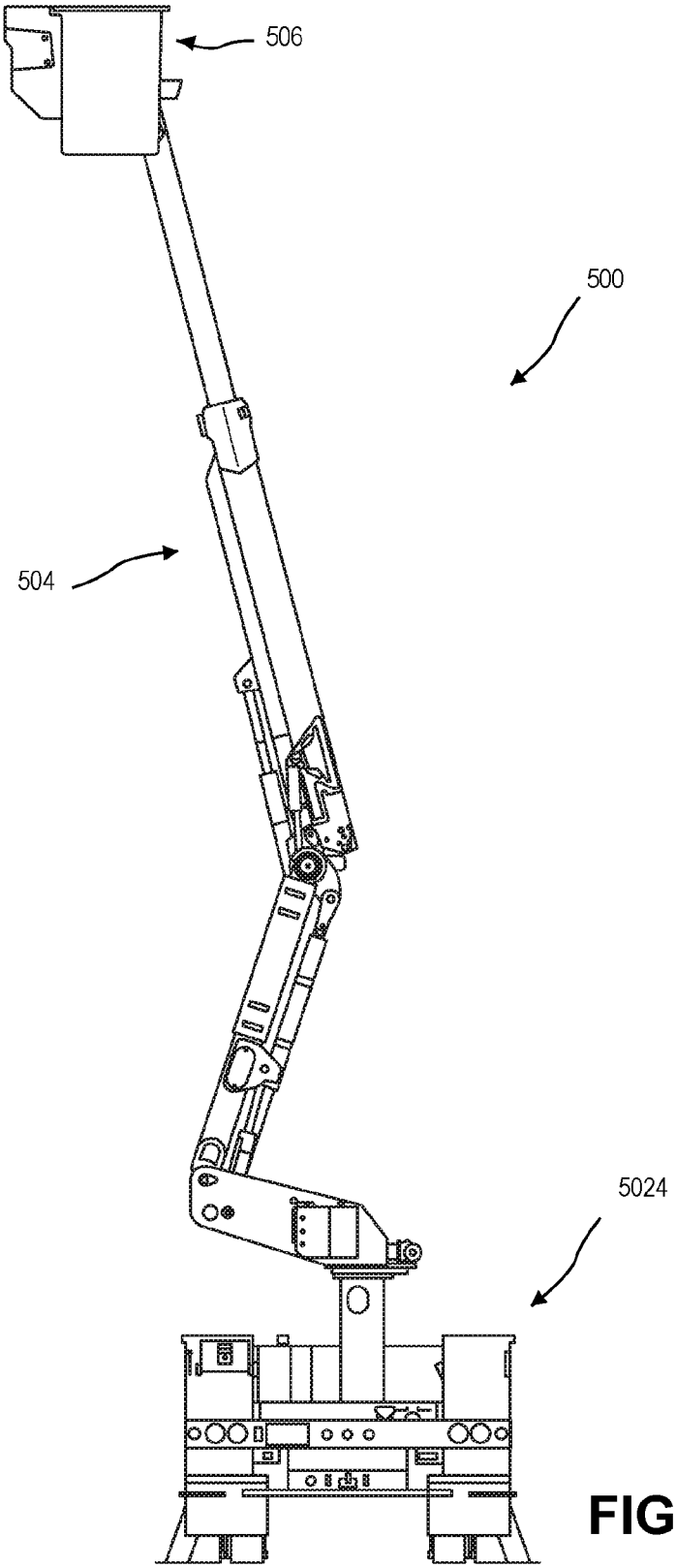
FIG. 5 is a side view of an exemplary aerial device that may incorporate the load-indicative alarm system to measure loads upon an aerial device and a utility platform.

An aerial device 500, constructed in accordance with various embodiments of the invention, is shown in FIG. 5. The aerial device 500 generally comprises a base 502 with a boom assembly 504 rotatably mounted thereto. A utility platform assembly 506 is disposed on the boom assembly 504 to provide an aerial platform for the accomplishment of a task by a utility worker. The base 502 of the aerial device 500 is a selectively stabilized platform. In embodiments of the invention, the base 502 is a utility truck, a crane base, an oilrig, an earth-working machine, or a fixed structure. The base 502 provides stability and a counterweight to a load being supported by the boom assembly 504 and/or the utility platform 506.

In embodiments of the invention, the boom assembly 504 broadly comprises a lower boom section and at least one insulated upper boom section. It should be appreciated that some embodiments of the invention are concerned with the detection of load upon the upper boom section. Because insulating a boom, such as by forming it of a polymer, significantly reduces the structural strength, monitoring the load thereon can prevent structural failure.

As illustrated in FIG. 5, some embodiments of the boom assembly 504 may further comprise at least one pivoting boom section. The boom assembly 504 presents a proximal end and a distal end. The proximal end is rotatably and/or pivotably secured to a portion of the base 502. The distal end is secured to the utility platform assembly 506. In some embodiments, the at least one upper boom section is at least in part disposed within the lower boom section. The at least one upper boom section telescopes to extend or retract into the lower boom section. In other embodiments, the upper boom section pivots relative to the lower boom section, such as illustrated in FIG. 5. The pivoting boom section does not telescope out of any other boom section. Instead the pivoting boom section rotates about the base 502, and the first boom section pivots and/or rotates relative to the pivoting boom section. The use of the pivoting boom section allows the utility platform assembly 506 to reach certain areas and avoid obstacles in the working environment.

The utility platform assembly 506 provides an elevated surface from which at least one utility worker can perform a task. As illustrated in FIG. 5, embodiments of the utility platform assembly 506 comprise four bucket sidewalls and a bucket floor that collectively form a cavity. The utility platform assembly 506 may also present a bucket lip along a top portion of at least one bucket sidewall 38. The utility platform assembly 506 may further comprise a step and/or a door (not illustrated) in at least one of the bucket sidewalls to allow for ingress and egress of the utility worker. The utility platform assembly 506 may also comprise a handrail (not illustrated).

The four bucket sidewalls and the bucket floor of the utility platform assembly 506 form the cavity. The four bucket sidewalls may be unitary, i.e. formed of a single monolithic structure, or they may be coupled together. The transition between successive bucket sidewalls, and/or between the bucket sidewalls and the bucket floor, may be rounded or arcuate.

In some embodiments, the utility platform assembly 506 presents a horizontal cross-section that is substantially rectangular. Thus, two of the opposing bucket sidewalls may have a greater width than the other two opposing bucket sidewalls. In other embodiments, the utility platform assembly 506 presents a horizontal cross-section that is substantially square. Other embodiments of the utility platform assembly 506 may be other shapes about the horizontal cross-section, such as an ellipse, a circle, a D-shape, a triangle, a trapezoid, a rhombus, or other quadrilateral.

In embodiments of the invention in which the load is upon an aerial device, the "load" is a vertically oriented weight placed upon the utility platform assembly 506 and/or the boom assembly 504. The load may be dependent upon the length and orientation of the boom assembly 504 relative to the base 502 and the utility platform assembly 506 relative to the boom assembly 504. The load may be caused the weight of operators and other persons, tools, replacement parts, removed parts, safety equipment, the utility platform assembly 506 itself, the boom assembly 504 itself, and other objects.

It should be appreciated that, while the above disclosure has been generally directed to the field of wood chippers and aerial devices, embodiments of the invention may be directed to other fields and uses. For example, embodiments of the invention may be used in motor vehicles to inform the driver if the safe parameters are being exceeded.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A load-indicative alarm system configured to alert an operator as to a load, the load-indicative alarm system comprising:

a load-measuring device for providing a first load indication;

a controller configured to determine a load level, wherein the controller is configured to determine the load level by acquiring the first load indication from the load-measuring device;

an alerting device configured to alert the operator, wherein the controller is configured to instruct the alerting device to alert the operator if the load level is above a minimum threshold, wherein the minimum threshold is variable and dependent on at least two factors, wherein the controller is configured to determine if the load level is above a maximum threshold, wherein the maximum threshold is variable and dependent on at least two factors, wherein at least one of said at least two factors is measured by the load-measuring device, wherein the alerting device provides a load-indicative alert that informs the operator of the load level being above the minimum threshold.

2. The load-indicative alarm system of claim 1, wherein the minimum threshold is associated with a safe operating condition.

3. The load-indicative alarm system of claim 1, wherein the controller is configured instruct preventative actions upon the load level exceeding the maximum threshold, wherein the maximum threshold is associated with imminent damage.

4. The load-indicative alarm system of claim 1, wherein the controller is configured to compare the load level against a set of intermediate thresholds, wherein the controller is configured to instruct a property of the load-indicative alarm based at least in part upon said comparison of the load level against the set of intermediate thresholds.

5. The load-indicative alarm system of claim 4, wherein the set of intermediate thresholds includes a low-intermediate threshold, a mid-intermediate threshold, and a high-intermediate threshold, wherein each intermediate threshold in the set of intermediate thresholds is between the minimum threshold and a maximum threshold.

6. The load-indicative alarm system of claim 1, wherein the load-indicative alarm is an audible signal characterized by a duty cycle, wherein the duty cycle includes a tonal portion and a silent portion.

7. The load-indicative alarm system of claim 6, wherein the tonal portion of the load-indicative alarm is proportional to an excess of the load level above the minimum threshold.

8. The load-indicative alarm system of claim 1, wherein the load is on an engine that is associated with a wood chipper.

9. The load-indicative alarm system of claim 1, wherein the load is a vertical weight on a boom assembly of an aerial device.

10. A computerized method of providing an alert to an operator that is indicative of a load, the method comprising the following steps:

acquiring a first load indication from a load-measuring device at a time T1;

determining a first load level based at least in part on the first load indication;

instructing an alerting device to provide a first load-indicative alert, wherein the first alert is indicative of the first load level;

acquiring a second load indication from the load-measuring device at a time T2;

determining a second load level based at least in part on the second load indication;

instructing the alerting device to provide a second load-indicative alert that is indicative of the second load level, wherein the second load-indicative alert is distinguishable from the first load-indicative alert, wherein the first load level is different than the second load level, wherein the first load level and the second load level are each above a minimum threshold, wherein the minimum threshold is variable and dependent on at least two factors, determining if the second load level is above a maximum threshold, wherein the maximum threshold is variable and dependent on at least two factors, wherein at least one of said at least two factors is measured by the load-measuring device.

11. The computerized method of claim 10, wherein the minimum threshold is associated with a safe operating condition.

12. The computerized method of claim 10, further comprising the following steps:

instructing preventative actions upon a determination that the second load level exceeds the maximum threshold, wherein the maximum threshold is associated with imminent damage.

13. The computerized method of claim 10, further comprising the following steps:

comparing the second load level against a set of intermediate thresholds, instructing a property of the load-indicative alarm based at least in part upon said comparison of the second load level against the set of intermediate thresholds.

14. The computerized method of claim 13, wherein the set of intermediate thresholds includes a low-intermediate threshold, a mid-intermediate threshold, and a high-intermediate threshold, wherein each intermediate threshold in the set of intermediate thresholds is between the minimum threshold and a maximum threshold.

15. The computerized method of claim 10, wherein the load-indicative alarm is an audible signal characterized by a duty cycle, wherein the duty cycle includes a tonal portion and a silent portion.

16. The computerized method of claim 15, wherein the tonal portion of the load-indicative alarm is proportional to an excess of the second load level above the minimum threshold.

17. A non-transitory computer readable medium having a computer program stored thereon for presenting a load-indicative alarm to an operator of machinery, wherein the computer program is configured to instruct a processing element to perform the following steps:

acquiring a first load indication from a load-measuring device at a time T1;

determining a first load level based at least in part on the first load indication;

instructing an alerting device to provide a first load-indicative alert, wherein the first alert is indicative of the first load level;

acquiring a second load indication from the load-measuring device at a time T2;

determining a second load level based at least in part on the second load indication;

instructing the alerting device to provide a second load-indicative alert that is indicative of the second load level, wherein the second load-indicative alert is distinguishable from the first load-indicative alert, wherein the first load level is different than the second load level, wherein the first load level and the second load level are each above a minimum threshold, wherein the minimum threshold is variable and dependent on at least two factors, determining if the second load level is above a maximum threshold, wherein the maximum threshold is variable and dependent on at least two factors, wherein at least one of said at least two factors is measured by the load-measuring device, wherein the minimum threshold is associated with a safe operating condition.

18. The non-transitory computer readable medium of claim 17, further comprising the following steps:

instructing preventative actions upon a determination that the second load level exceeds the maximum threshold, wherein the maximum threshold is associated with imminent damage.

19. The non-transitory computer readable medium of claim 17, further comprising the following steps:

comparing the second load level against a set of intermediate thresholds, instructing a property of the load-indicative alarm based at least in part upon said comparison of the second load level against the set of intermediate thresholds, wherein the set of intermediate thresholds includes a low-intermediate threshold, a mid-intermediate threshold, and a high-intermediate threshold, wherein each intermediate threshold in the set of intermediate thresholds is between the minimum threshold and a maximum threshold, wherein the property instructed provides an indication to the operator of which intermediate threshold in the set of intermediate thresholds is exceeded by the second load level.

20. The non-transitory computer readable medium of claim 17, wherein the load-indicative alarm is an audible signal characterized by a duty cycle, wherein the duty cycle includes a tonal portion and a silent portion, wherein the tonal portion of the load-indicative alarm is proportional to an excess of the load level above the minimum threshold.

* * * * *